United States Patent [19]

Wixon

[11] 4,224,250

[45] Sep. 23, 1980

[54] NOVEL FABRIC CONDITIONING COMPOUNDS

[75] Inventor: Harold E. Wixon, New Brunswick, N.J.

[73] Assignee: Colgate-Palmolive Company, New York, N.Y.

[21] Appl. No.: 802,933

[22] Filed: Jun. 2, 1977

Related U.S. Application Data

[60] Division of Ser. No. 517,577, Oct. 23, 1974, Pat. No. 4,049,557, which is a continuation-in-part of Ser. No. 272,388, Jul. 17, 1972, abandoned.

[51] Int. Cl.[2] ..... C07C 83/00; C07C 87/16; D06M 13/38

[52] U.S. Cl. ..... 260/584 R; 252/8.8

[58] Field of Search ..... 260/584 R, 583 P; 252/8.6, 8.8

[56] References Cited

U.S. PATENT DOCUMENTS

| | | | |
|---|---|---|---|
| 3,697,423 | 10/1972 | Sundby et al. | 260/584 R |
| 3,928,422 | 12/1975 | Sundby | 260/584 R |
| 3,928,427 | 12/1975 | Diana et al. | 260/584 R |
| 3,959,378 | 5/1976 | Eckert | 260/584 R |
| 4,022,833 | 5/1977 | Diana et al. | 260/584 R |
| 4,110,379 | 8/1978 | Adong et al. | 260/584 R |
| 4,126,640 | 11/1978 | Floyd | 260/584 R |

*Primary Examiner*—Joseph L. Schofer
*Assistant Examiner*—Peter F. Kulkosky
*Attorney, Agent, or Firm*—Herbert S. Sylvester; Murray M. Grill; Norman Blumenkopf

[57] ABSTRACT

Novel fabric conditioning compounds are formed by reacting a higher alkyl-1, 2-epoxide with a lower alkanediamine. The compounds may be incorporated into a laundry product and used in the wash cycle or may be applied in either the wash cycle or the rinse cycle.

4 Claims, No Drawings

NOVEL FABRIC CONDITIONING COMPOUNDS

This is a divisional of application Ser. No. 517,577 filed Oct. 23, 1974 and now U.S. Pat. No. 4,049,557 which is in turn a continuation-in-part of application Ser. No. 272,388, filed July 17, 1972 and now abandoned.

BACKGROUND OF THE INVENTION

This invention relates to novel fabric conditioning compounds that are compatible with anionic detergents.

Textile softener compositions are utilized in the textile industry to give the fiber or fabric a better handle or feel and a better drape. They quite often also act as lubricants and antistatic agents. In the manufacture of textiles, after completion of the various process steps, the fabric is finished by various treatments which often include the application of a softener. These finishes, particularly softeners, are removed by washing and, recently, a number of softeners for use in home and industrial washing machines have been placed on the market, which softeners restore to the washed goods the original feel and drape properties. The home laundry softeners are recommended for use in the washing machine after the wash period and usually after at least one or more rinse periods. These softeners are generally referred to as "after rinse" softeners.

The after-rinse softeners are usually formulated into 4–8% active, liquid products and bottled for use in the home. To date, these products have been generally based on the dimethyl-di(hydrogenated tallow)-ammonium chloride type fabric softeners. Although these products are excellent for improving the hand of fibers and fabrics, they are incompatible with anionic detergents and have the tendency to build up on successive washes resulting in reduced absorbency of the washed and treated fabrics. In addition, these products are not always compatible with germicidal compounds, even cationic germicidal compounds such as n-alkyl-dimethyl-aryl-ammonium chlorides. In the latter case, a gelling effect takes place in the detergent-germicide system, and the product is no longer pourable from a bottle.

In recent years, many detergent compositions have been formulated based upon linear alkyl benzene sulfonates, compounds thought to possess the best detergency characteristics. While such anionic detergents do possess excellent detergency characteristics, the use of linear alkyl benzene sulfonates and other anionic detergents based upon the alkyl aryl sulfonates has certain distinct shortcomings. Since the alkyl aryl sulfonates or linear alkyl benzene sulfonates do not possess any fabric-softening characteristics, it is necessary to employ an additional fabric softener when using such anionic detergents. Since, however, the preferred fabric softeners are of the cationic quaternary ammonium type, such fabric softeners cannot be formulated in the same detergent composition with the anionic detergent. Thus the conjoint employment of the anionic detergent and the cationic fabric softener is precluded, since such fabric softeners and detergents complex and precipitate when employed conjointly, thereby eliminating the functional characteristics of each of the materials. Accordingly, it has been found necessary to employ the quaternary ammonium fabric softener in the rinse cycle of the fabric-washing process so that no contact between the anionic detergent and the cationic fabric softener will occur. This, of course, provides a great inconvenience in textile washing, since it necessitates the addition of active ingredients at two separate points in the washing cycle.

SUMMARY OF THE INVENTION

Compounds have now been discovered which have been found particularly suitable for fabric softeners. The novel softener compositions of the present invention can be utilized in the following manner:

(1) As a softener during the wash cycle;

(2) As an after-rinse softener;

(3) In built detergents for heavy-duty cleaning that can be added:

(a) to the slurry before spray drying (b) to heavy-duty liquids

For the above uses a softener composition must perform as follows:

(1) The softener must be substantive;

(2) The softener must provide a good hand and fluffiness to the fabric;

(3) The softener must have non-yellowing properties; and (4) The softener must be effective and stable in a pH range of 10 to 11.

The compounds of this invention not only improve the handle of the fiber or fabric, but are versatile enough that they can be applied as previously mentioned, as a softener during the wash cycle, as an after-rinse softener, and are also compatible with additives such as optical whiteners, germicidal compounds, etc.

Built-in detergents with the softener component enable the launderer to wash and soften in one operation. In other words, in a single addition of built-in detergent with softener, the goods can now be secured, and, since the softener is substantive, softened in one cycle; thus eliminating the two-step operation wherein the detergent is added in the wash cycle and the softener in the after-rinse cycle.

In these anionic type built detergent systems the dimethyl-di(hydrogenated tallow)-ammonium chloride base softeners are not applicable. Being cationic in chemical nature and opposite in electronic charge they are not compatible with anionic materials.

The fabric softening compounds of the present invention are valuable in the respect that they are compatible with anionic built detergents containing, if desired, optical whiteners, germicidal compounds, etc.

It has been found that the reaction of higher alkyl-1,2-epoxides with lower alkanediamines produces compounds having utility as fabric softeners which may be incorporated into a laundry product and used in conjunction with a detergent or added separately in either the wash cycle or the rinse cycle.

Said compounds have the formula $R_1$-NH-$(CH_2)_x$-NH-$R_2$ wherein $R_1$ contains about 10 to 22 carbon atoms and is selected from the group consisting of 1-hydroxymethyl alkyl and 2-hydroxy alkyl, $R_2$ is H or $R_1$, and x is an integer from 2 to 12.

The reaction may be postulated as follows:

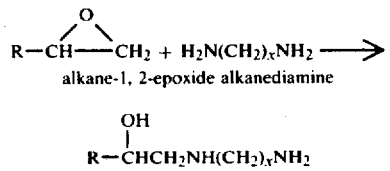

(a)

-continued

N-(2-hydroxyalkyl) alkanediamine $$R-CH(CH_2OH)-NH(CH_2)_xNH_2 \quad (b)$$

N-(1-hydroxymethyl alkyl) alkanediamine $$R-CH(OH)-CH_2NH(CH_2)_xNHCH_2-CH(OH)-R \quad (c)$$

N,N'-(2-hydroxyalkyl) alkanediamine, or $$R-CH(CH_2OH)-NH(CH_2)_xNH-CH(CH_2OH)-R \quad (d)$$

N,N'(1-hydroxymethyl) alkanediamine where R is an alkyl group having from about 8 to about 20 carbon atoms, and x is an integer from 2 to 12.

The above reaction gives mixtures of mono- and di-substituted alkanediamines, the proportions varying with the reaction conditions and the mole ratio of epoxide to diamine. Compounds (a)–(d) are the most probable products of the reaction. Where the mole ratio of alkanediamine to epoxide is 2:1, mono-substituted reaction products predominate [(a) and (b)]. Where the mole ratio of alkanediamine to epoxide is 1:2, di-substituted reaction products predominate [(c) and (d)].

The resulting compounds, in addition to their fabric softening properties, also possess anti-static properties, which make them particularly valuable for treating synthetic textile materials which readily assume a static electric charge, such as nylon, glycol terephthalate (Dacron), acrylonitrile polymers such as Orlon, Acrilan, and Dynel, and cellulose acetate.

The compounds of the present invention may be used in detergent compositions with a variety of active ingredients, including synthetic detergents, soaps, detergent builders, sequestering agents, fluorescent whiteners, bluing agents, and foam control agents.

The compounds of the present invention can be used with one or a mixture of anionic detergents. The anionic detergents may be designated as water-soluble, salts of organic reaction products having in their molecular structure an anionic solubilizing group such as $SO_4H$, $SO_3H$, COOH and $PO_4H$, and an alkyl or aralkyl radical having about 8 to 22 carbon atoms in the alkyl group. Suitable detergents are anionic detergent salts having alkyl substituents of 8 to 22 carbon atoms, such as water-soluble higher fatty acid alkali metal soaps, e.g., sodium myristate and sodium palmitate; water-soluble sulfated and sulfonated anionic alkali metal and alkaline earth metal detergent salts containing a hydrophobic higher alkyl moiety, such as salts of higher alkyl mono- or poly-nuclear aryl sulfonates having from about 8 to 18 carbon atoms in the alkyl group which may have a straight or branched structure, e.g., sodium dodecylbenzene sulfonate, magnesium tridecylbenzene sulfonate, lithium or potassium pentapropylene benzene sulfonate; alkali metal salts of sulfated condensation products of ethylene oxide (e.g. 3 to 20 and preferably 3–10 mols of ethylene oxide per mol of other compound) with aliphatic alcohols containing 8 to 18 carbon atoms, or with alkyl phenols having alkyl groups containing 6 to 18 carbon atoms, e.g., sodium nonyl phenol pentaethoxamer sulfate and sodium lauryl alcohol triethoxamer sulfate; alkali metal salts of sulfated alcohols containing from about 8 to 18 carbon atoms, e.g., sodium lauryl sulfate and sodium stearyl sulfate; alkali metal salts of higher fatty acid esters of low molecular weight alkylol sulfonic acid, e.g. fatty acid esters of the sodium salt of isethionic acid, fatty ethanolamide sulfates; fatty acid amides of amino alkyl sulfonic acids, e.g., lauric acid amide of taurine; alkali metal salts of hydroxy alkane sulfonic acids having 8 to 18 carbon atoms in the alkyl group, e.g., hexadecyl alpha-hydroxy sodium sulfonate. In general these organic surface active agents are employed in the form of their alkali metal salts or alkaline earth metal salts because such salts possess the requisite stability, water solubility, and low cost essential to practical utility.

The novel fabric softening compounds of the present invention may also be used with nonionic detergent compounds, such as low-foaming ethylene oxide condensate type detergents. Examples thereof are the reaction products of benzyl chloride and ethoxylated alkyl phenol having the formula

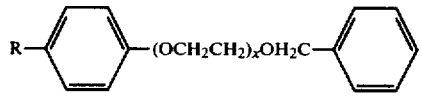

where R is an alkyl chain having from 6 to 12 carbon atoms and X is a whole number from 12 to 20; polyether esters of the formula $$(ClC_6H_4)_2CHCO_2(CH_2CH_2O)_xR$$

where x is an integer from 4 to 20 and R is a lower alkyl group of not over four carbon atoms, e.g., a compound of the formula $$(ClC_6H_4)_2CH\text{-}CO_2(CH_2CH_2O)_{15}CH_3$$

and polyalkylene oxide condensates of an alkyl phenol, such as the polyglycol ethers of alkyl phenols having an alkyl group of at least about 6 and usually about 8 to 20 carbon atoms and an ethylene oxide ratio (number of ethenoxy groups per mole of condensate) of about 7.5, 8.5, 11.5, 20.5, 30, and the like. The alkyl substituent on the aromatic nucleus may be di-isobutylene, diamyl, polymerized propylene, isooctyl, nonyl, dimerized $C_6$–$C_7$-olefin, and the like. Among other condensates with phenols is an alkylated $\beta$-naphthol condensed with 8 moles of ethylene oxide, the alkyl group having 6 to 8 carbon atoms.

Further suitable detergents are the polyoxyalkylene esters of organic acids, such as the higher fatty acids, rosin acids, tall oil, or acids from the oxidation of petroleum, and the like. The polyglycol esters will usually contain from about 8 to about 30 moles of ethylene oxide or its equivalent and about 8 to 22 carbon atoms in the acyl group. Suitable products are refined tall oil condensed with 16 to 20 ethylene oxide groups, or similar polyglycol esters of lauric, stearic, oleic and like acids.

Additional suitable non-ionic detergents are the polyalkylene oxide condensates with higher fatty acid amides, such as the higher fatty acid primary amides and higher fatty acid mono- and di-ethanol-amides. Suitable agents are coconut fatty acid amide condensed with about 10 to 30 moles of ethylene oxide. The fatty acyl group will similarly have about 8 to 22 carbon atoms, and usually about 10 to 18 carbon atoms in such products. The corresponding sulphonamides may also be used if desired.

Other suitable polyether nonionic detergents are the polyalkylene oxide ethers of higher aliphatic alcohols. Suitable alcohols are those having a hydrophobic character, and preferably 8–22 carbon atoms. Examples thereof are iso-octyl, nonyl, decyl, dodecyl, tridecyl, tetradecyl, hexadecyl, octadecyl, and oleyl alcohols which may be condensed with an appropriate amount of ethylene oxide, such as at least about 6, and preferably about 6, and preferably about 10–30 moles. A typical product is tridecyl alcohol, produced by the Oxo process, condensed with about 12,15, or 20 moles of ethylene oxide. The corresponding higher alkyl mercaptans or thioalcohols condensed with ethylene oxide are also suitable for use in compositions of the present invention.

The water soluble polyoxyethylene condensates with polyoxypropylene polymers may likewise be employed in compositions of the present invention. The polyoxypropylene polymer, which is prepared by condensing propylene oxide with an organic compound containing at least one reactive hydrogen, represents the hydrophobic portion of the molecule, exhibiting sufficent water insolubility per se, at a molecular weight of at least about 900, such as about 900 to 2400, and preferably about 1200 to 1800. The increasing addition or condensation of ethylene oxide or a given water insoluble polyoxypropylene polymer tends to increase its water solubility and raise the melting point such that the products may be water soluble, and normally liquid, paste or solid in physical form. The quantity of ethylene oxide varies with the molecular weight of the hydrophobic unit but will usually be at least about 20% and preferably at least about 40% by weight of the product. With an ethylene oxide content of about 40 up to 50%, there are usually obtained normally liquid products, above 50% soft waxlike products, and from about 70–90% normally solid products may be obtained which can be prepared in flake form if desired. These condensates may be designated by the following structure:

$$Y[(C_3H_6O)_n—E—H]_x$$

where

Y is the residue of an organic compound which contained x active hydrogen atoms.

n is an integer x is an integer, the value of n and x being such that the molecular weight of the compound, exclusive of E, is at least 900, as determined by hydroxy number, E is a polyoxyethylene chain and constitutes 20–90%, by weight of the compound, and H is hydrogen.

It is preferred to use products of the type just described having a total molecular weight within the range 2000 to 10,000, and preferably about 4000 to 8000. A suitable material is a condensate having a typical average molecular weight of about 7500, the hydrophobic polypropylene glycol being condensed with sufficient ethylene oxide until a normally solid water-soluble product is obtained which has an ethylene oxide content of about 80–90% and a melting point usually of about 51°–54° C. Another material is a liquid condensate having an ethylene oxide content of 40–50% and a molecular weight of about 4500.

The fabric softening compounds may be used in detergent formulations containing soaps, such as soaps of tallow fatty acid, coconut fatty acid, cottonseed fatty acid, oleic acid, and the like. The fabric softeners may be employed with detergent soaps derived from all types of fatty monocarboxylic acids ranging in chain length from $C_{10}$ to $C_{22}$, both saturated and unsaturated.

The fabric softeners of the present invention are compatible with the commonly used alkaline builder salts and sequestering agents, inorganic or organic, illustrative of which are:

Tetrasodium phosphate
Tetrasodium pyrophosphate
Sodium acid pyrophosphate
Sodium tripolyphosphate
Sodium monobasic phosphate
Sodium hexametaphosphate
Sodium metasilicate
Sodium silicates of $Na_2O/SiO_2$ of 1.6/1 to 3.2/1
Sodium carbonate
Sodium sulfate
Sodium citrate
Borax
Sodium perborate
Nitrilotriacetic acid trisodium salt
Ethylene diamine tetracetic acid tetrasodium salts, and the like The alkali metal polyphosphate builder salts are preferred for use in combination with anionic detergents, as the polyphosphate salts enhance the detersive efficiency of anionic detergents, aid in controlling sudsing powers, and aid in keeping soil suspended in the washing bath after its removal from the soiled textiles.

Examples of various other materials with which the fabric softener of the present invention are compatible and which may be incorporated in detergent compositions containing these fabric softeners include higher fatty acid amides such as coconut or lauric monoethanolamide, isopropanolamide and the like; hydrotropic solubilizing agents such as xylene or toluene sulfonates; organic solubilizing agents such as ethanol, ethylene glycol, and hexylene glycol; sodium carboxymethylcellulose and polyvinyl alcohol antiredeposition agents; optical and fluorescent brightener materials; coloring agents; corrosion inhibiting agents; germicides; perfumes; bluing agents; and the like.

The detergent compositions containing the fabric softening compounds of this invention may be spray-dried, mechanical mixtures, liquids, pastes, tablets, etc.

In one process of formulating a detergent composition containing the novel fabric softeners, a fluid aqueous slurry comprising water and an anionic organic detergent with a fatty acid salt is formed. The slurry flows or is pumped into a conventional soap crutcher or any other suitable mixing apparatus such as a ribbon blender. The other ingredients are then added in suitable order and form. The fabric softener is then added with stirring. The resulting slurry should be sufficiently fluid at elevated temperatures to insure adequate mixing and formation of a uniform product, and is subjected to a heat treatment at an elevated temperature such as within the range of about 100° to about 200° F., and usually from about 130° to 155° F. The slurry is heated by external means or even by the exothermic heat of reaction of certain ingredients. For example, the addition of hydratable inorganic salts such as the anhydrous forms of sodium tripolyphosphate and sodium pyrophosphate results in exothermic reactions as hydration occurs. It is desirable generally to add the polyphosphate and/or other builder salt or salts in the final stages of the crutching operation. A fatty acid salt can be added at any suitable stage of the crutching operation, preferably before addition of the polyphosphate. Mixing time is sufficient to ensure adequate mixing and will usually be at least a few minutes, e.g., five minutes. To facilitate density control of the desired products, effective agitation is maintained throughout the crutching operation. Such agitation provides a vortex such that a substantial amount of air is incorporated into the mixture present in the crutcher. Aerated mixtures have lower specific gravities and the resulting spray dried products have lower densities. The aqueous mixture prior to drying can be aged at the elevated temperature for a time sufficient to cause adequate solubilization or hydration of certain ingredients. Such aging period can be a number of hours, such as up to about 8 hours. In general, it is preferred to employ time intervals of less than three hours and preferably less than one hour. It is understood that excessively high temperatures or unduly long aging periods are to be avoided to prevent any possible decomposition and ensure efficient processing.

The solids content of the aqueous slurry is usually within the range of from about 20 percent to 90 percent of total solids. In the manufacture of heat-dried products involving vaporization of the water, the solids content is usually within the range of about 40 to 65 percent by weight, the remainder being substantially free water content. The slurry is usually maintained at a temperature of from about 160° to 180° F. This slurry is subjected to known spray-drying operations utilizing temperatures above 212° F. to produce the detergent composition in particulate form, generally in the form of hollow, thin-walled spherical particles. The detergent composition can be transformed into beads, granules, flakes, chips, powders, or the like as desired by use of conventional techniques.

In spray-drying the aqueous slurry, it is atomized or forced through spray nozzles into towers, with small liquid particles discharged from the nozzles becoming solidified and drying as they contact or fall through a stream or vortex of heated air or other inert gas which is about 600° F. The composition is produced thereby in the form of hollow thin-walled spheres or beads having a small residual moisture content usually of about 3 to 15 percent by weight.

Where the softening compounds of the present invention are mixed with a detergent, the softener is present in amounts ranging from about 1% to about 20%, and preferably from about 2% to about 15%, the surfactant is present in amounts ranging from about 5% to about 40% and preferably from 10% to 30%, and builder salts and other ingredients are present in amounts ranging from about 40% to about 94%.

Besides application in combination detergent/softener compositions, the fabric softeners of the present invention may be used in fabric softening compositions to be used either in the wash cycle with regular detergents or in the rinse cycle.

For use in the wash cycle, the fabric softener is dispersed in suitable solvents or, in dry form, is absorbed on a suitable carrier. Suitable carriers for this purpose include sodium sulfate, sodium carbonate, phosphate builder salts, clays, sugar, and the like. The fabric softener is generally present in the range of 5–30% active ingredient in the ultimate formulation. About 5 to 15 grams of active ingredient fabric softener can be used per average eight pound wash load. Brighteners, bluing agents, germicides, dispersing agents, and the like could be incorporated in the final formulation.

For use in the rinse cycle, the fabric softener is dispersed in suitable solvents or, in dry form, is absorbed on a suitable carrier. The concentration of fabric softener can be reduced somewhat, so that between 1 gram and 5 grams of active ingredient are used per average eight pound wash load.

DESCRIPTION OF THE PREFERRED EMBODIMENTS

In order to quantitatively determine the efficacy of fabric softener/detergent compositions prepared according to the present invention, the Mini-Wash test was developed. One-half of a terrycloth hand towel is washed in the Mini-Wash attachment of a General Electric automatic washer, using about 3 gallons of tap water (about 100 ppm. hardness) at 120° F. After air-drying, the half towel is rated on a softness scale of "1"=no softness to "10"=excellent softness, the softness attained by the standard fabric softener, stearyl dimethyl amine oxide. In those instances where the test softener exceeds the "10" standard, plus (+) values are assigned to help quantify the superiority.

EXAMPLE I

A mixture of 27 g. (0.12 mole) 1,2-epoxytetradecane and 18.5 g. (0.25 mole) 1,3-propane diamine was heated on a steam bath for five days. When chilled, the mixture crystallized. The product was broken up and washed thoroughly with ether. The 25 g. of material remaining was recrystallized from 200 ml. 3A alcohol.

A mixture of the above fabric softening compound and detergent was formulated from the following ingredients:

2 grams linear tridecylbenzene sulfonate
6.6 grams sodium tripolyphosphate builder
1 gram fabric softener When this mixture was used in the Mini-Wash test, the half towel was rated at a softness of 10++++.

Another mixture of the fabric softening compound of Example I and detergent was formulated as follows:

2 grams linear tridecylbenzene sulfonate
6.6 grams sodium tripolyphosphate builder
0.5 gram fabric softener When this mixture containing a lower concentration of softener was used in the Mini-Wash test, the half towel was given a softness rating of 8.

The fabric softener of Example I was mixed with a nonionic detergent as follows:

2 grams polyethoxylated $C_{14}$–$C_{15}$ primary alcohol (average 11 moles ethylene oxide)
6.6 grams sodium tripolyphosphate
1 gram fabric softener In the Mini-Wash test, use of this formulation resulted in a towel having a softness rating of 7.

The fabric softener of Example I was then formulated with a blend of nonionic and anionic detergents:

1 gram linear tridecylbenzene sulfonate
1 gram polyethoxylated $C_{14}$–$C_{15}$ primary alcohol (average 11 moles ethylene oxide)
6.6 grams sodium tripolyphosphate builder
1 gram fabric softener When this mixture was used in the Mini-Wash test, the hand towel was rated at a softness of 8.

EXAMPLE II

A mixture of 0.11 mole of 1,2-epoxyhexadecane and 0.336 mole of 1, 3-diaminopropane was heated on a steam bath overnight. When chilled, the mixture crystallized. The product was broken up and washed thoroughly with ether, and then recrystallized from alcohol. The resulting fabric softener was formulated with a detergent as follows:

1 gram fabric softener
2 grams linear tridecylbenzene sulfonate
6.6 grams sodium tripolyphosphate When this formulation was used in the Mini-Wash test, the terrycloth towel was given a softness rating of 10+.

EXAMPLE III

A mixture of 0.10 mole of 1,2-epoxyoctadecane and 0.20 mole of 1,3-diaminopropane was heated on a steam bath for 6.5 hours. When chilled, the mixture solidified. The product was broken up and washed thoroughly with ether, and then recrystallized from alcohol. The resulting fabric softener was formulated with a detergent as follows:

1 gram fabric softener
2 grams linear tridecylbenzene sulfonate
6.6 grams sodium tripolyphosphate When this formulation was used in the Mini-Wash test, the terrycloth towel was given a softness rating of 3. This low softness rating would indicate that the reaction time was too short for a good yield of product.

EXAMPLE IV

A mixture of 0.10 mole of 1,2-epoxy-octadecane and 0.05 mole of 1,3-propane diamine was heated on a steam bath for 22 hours. When chilled, the mixture crystallized. The product was broken up and washed thoroughly with ether and then recrystallized from alcohol.

EXAMPLE V

A mixture of 0.10 mole of 1,2-epoxyoctadecane and 0.05 mole of 1,6 hexane diamine was heated in a 100° C. oven for three days. The product was left at room temperature for three days, and was then recrystallized from alcohol.

The fabric softeners formed in the reactions of Examples IV and V were added to detergents according to the following formula:

1 gram fabric softener
2 grams linear tridecylbenzene sulfonate
6.6 grams sodium tripolyphosphate The formulations were then used in the Mini-Wash test, and the softness ratings of the fabric softeners described in the preceding examples is given in the following tables:

| Example No. | Softness |
|---|---|
| IV | 10 |
| V | 10 |

It is thus apparent that the di-substituted diamine reaction products are equal or superior to the mono-substituted diamine reaction products in softening ability.

What is claimed is:

1. The product of the reaction of at least one mole of an alkanediamine of the formula $$H_2N(CH_2)_xNH_2$$

with one mole of an alkyl -1,2-epoxide of the formula

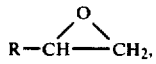

said product being predominantly a compound or mixture of compounds selected from the group consisting of those of the formulae $$R-\underset{}{\overset{OH}{\overset{|}{CH}}}-CH_2-NH-(CH_2)_x-NH_2, \text{ and} \quad (a)$$

$$R-\overset{CH_2OH}{\overset{|}{CH}}-NH-(CH_2)_x-NH_2, \quad (b)$$

R in the above formulae being $C_8$-$C_{20}$ alkyl and x in the above formulae being an integer from 2 to 12.

2. A compound or mixture of compounds as defined in claim 1 wherein R is derived from 1,2-epoxytetradecane, 1,2-epoxyhexadecane or 1,2-epoxyoctadecane.

3. A compound or mixture of compounds as defined in claim 2 wherein x has a value of 3.

4. A compound or mixture of compounds as defined in claim 2 wherein x has a value of 6.

* * * * *